United States Patent [19]

Smith

[11] 4,052,801

[45] Oct. 11, 1977

[54] DREDGING SYSTEM AND METHODS OF DREDGING

[76] Inventor: Leward N. Smith, Millbrook Road, Rte. 1, Remus, Mich. 49340

[21] Appl. No.: 681,275

[22] Filed: Apr. 28, 1976

[51] Int. Cl.[2] ..... E02F 3/92

[52] U.S. Cl. ..... 37/64; 37/195; 241/278 R

[58] Field of Search ..... 37/64–67, 37/195; 241/278 R

[56] References Cited

U.S. PATENT DOCUMENTS

| | | | |
|---|---|---|---|
| 222,380 | 12/1879 | Chaquette | 37/67 |
| 341,539 | 5/1886 | Angell | 37/67 |
| 388,253 | 8/1888 | Bowers | 37/65 |
| 709,861 | 9/1902 | Bates | 37/67 |
| 887,506 | 5/1908 | Newcomb | 37/67 |
| 3,474,549 | 10/1969 | Schnell | 37/64 X |
| 3,807,066 | 4/1974 | Proehl | 37/67 |
| 3,867,772 | 2/1975 | Smith | 37/195 |
| 3,877,159 | 4/1975 | Boomstra | 37/64 |

FOREIGN PATENT DOCUMENTS

| | | | |
|---|---|---|---|
| 1,463,335 | 11/1966 | France | 37/64 |
| 582,374 | 8/1933 | Germany | 37/64 |
| 1,113,669 | 9/1961 | Germany | 37/64 |

*Primary Examiner*—Clifford D. Crowder
*Attorney, Agent, or Firm*—Learman & McCulloch

[57] ABSTRACT

A dredging system for excavating difficult-to-dig material wherein a cutterhead is supported on a boom mounted on a floatable vessel and a suction conduit communicating with a suction developing mechanism leads to the cutterhead housing. The cutterhead housing is mounted for pivotal movement about a generally longitudinal axis on the longitudinally extending boom and has a vertically disposed rotary disc supported in the cutterhead housing forwardly of a material collecting compartment for rotation about a transverse axis. At least one opening is provided through the disc and a knife is mounted on the outer face of the disc in a position to cut material and to propel it through the opening to the material receiving compartment from which it is moved into the suction conduit and removed to a remote location. Because the cutterhead housing and its rotary disc are supported for powered pivotal movement on the boom about a generally longitudinal axis, the cutterhead can, at the ends of its sidewise paths of travel in each direction be turned stepwise end-for-end, cutting a path for itself as it moves to a position in which it can take a return cut at a lower level.

14 Claims, 11 Drawing Figures

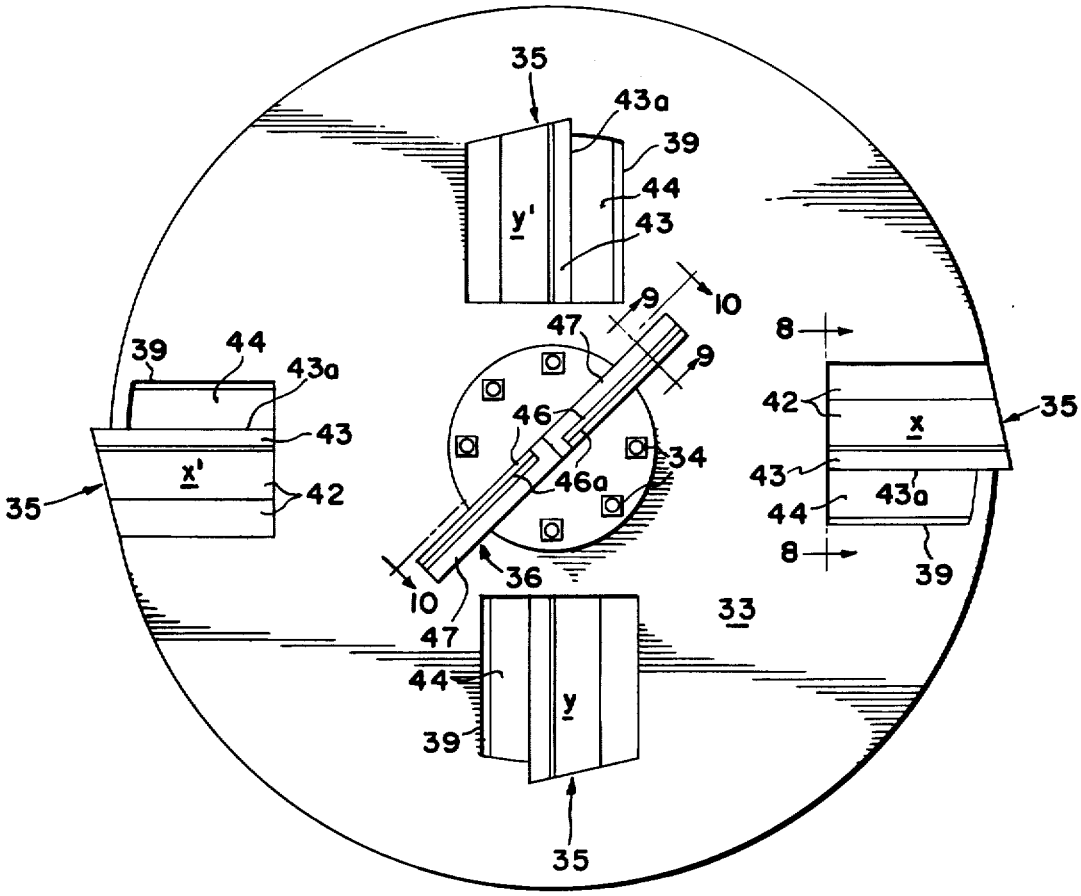
FIG.7
FIG.9
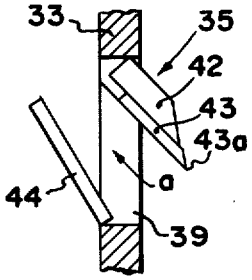
FIG.8
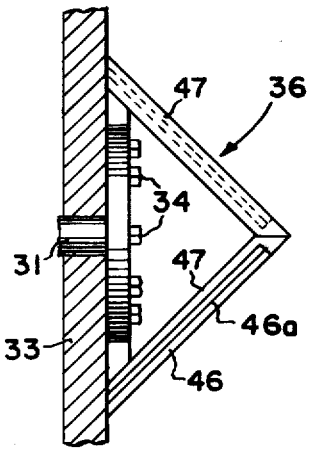
FIG.10

DREDGING SYSTEM AND METHODS OF DREDGING

BACKGROUND OF THE INVENTION

The invention relates to underwater excavating apparatus of the type generally disclosed in my U.S. Pat. No. 3,919,791 issued Nov. 18, 1975, which is incorporated herein by reference. It is directed particularly to apparatus for excavating difficult-to-dig material such as, for example, Carolina marl, hard clays, and tightly packed coal fines, and removing it to a dry land location. Previously, I have used a disc-type chipper in conjunction with dredging apparatus of the type employing a conventional cutterhead for the purpose of chipping up brush and tree growth ahead of the dredging cutterhead to prevent it from fouling the cutterhead.

The present invention utilizes a rapidly rotating disc-type cutterhead as the excavating head and mounts it for 180° rotation so that the continuously powered cutterhead is able to literally cut its way to a reversed position in which it can take a return path cut at a lower level. At the same time a material collecting chamber is provided rearwardly of the disc cutterhead, leading to a suction pipe, and pump vanes are provided on the disc-type cutterhead to literally "supercharge" the suction pump conventionally provided on dredges to remove the slurry collected to a remote location.

It is to be understood that it is contemplated that the dredge boom may preferably be swung in transverse or sidewise arcs to take successive cuts by stepping the dredge forwardly alternatively about a pair of rearwardly located anchoring spuds as disclosed in my U.S. Pat. No. 3,777,375, issued Jan. 28, 1972 (also incorporated herein by reference), or may be swung with the dredging hull about a tail section as disclosed in my U.S. Pat. No. 3,919,791.

One of the prime objects of the present invention is to provide underwater dredging apparatus for difficult-to-excavate materials wherein a rotary disc cutter is connected to a dredge pump in a manner which will permit it to be power turned end-for-end in 90° steps separated by a lowering step so that it may be employed to cut or excavate material on a continuous basis.

Another object of the invention is to provide a dredging system of the character described in which the cutter develops a pumping action which aids and, in a sense, "supercharges," the slurry pump carried by the dredge vessel.

Still another object of the invention is to provide a dredging system of the character described which requires relatively low boom swing forces while cutting material which is considered extremely difficult, if not impossible, to cut or dredge, the present cutterhead being of a type which cuts a thin slice of material and pulls it away from the body of material being excavated rather than putting the material in compression while digging it.

A correlative object of the invention is to provide a construction of the type described wherein the dredging of difficult-to-excavate material can, because of the low loading forces generated, proceed at a greatly accelerated pace, with resultant lower costs and vastly increased capacity.

Still another object of the invention is to provide a dredge system which can pulverize the material to a far greater extent than known systems where that is desirable.

Still another object of the invention is to provide a construction of the character described which essentially uses a dual pump system, in which a first pump "crams" the conventional pump used to remove slurry material, and permits it to operate much more efficiently and to handle far greater capacities by volume of solid material.

Still a further object of the invention is to provide a dredging system which pulverizes the material to a far greater extent than conventional excavating systems, with the result that the material is easier to remove and plugging problems are largely obviated.

SUMMARY OF THE INVENTION

An apparatus and method for excavating material such as marl from an underwater basin employing a disc-type cutterhead provided as the front wall of a material collecting compartment which communicates with a slurry removing suction pipe. The cutterhead is movable 180° about a longitudinal axis transverse to the axis of disc rotation and the disc incorporates pump means which "supercharge" the suction pump normally carried on the dredging vessel.

Other objects and advantages of the invention will be pointed out specifically or will become apparent from the following description when it is considered in conjunction with the appended claims and the accompanying drawings, in which:

FIG. 7 is an enlarged view of the cutterhead disc only, illustrating the construction thereof;

FIG. 8 is a transverse sectional view taken on the line 8—8 of FIG. 7 and illustrating one of the pumping vanes which is employed opposite each knife;

FIG. 9 is a transverse sectional view taken on the line 9—9 of FIG. 7;

FIG. 10 is a transverse sectional view taken on the line 10—10 of FIG. 7; and

Figure 1:
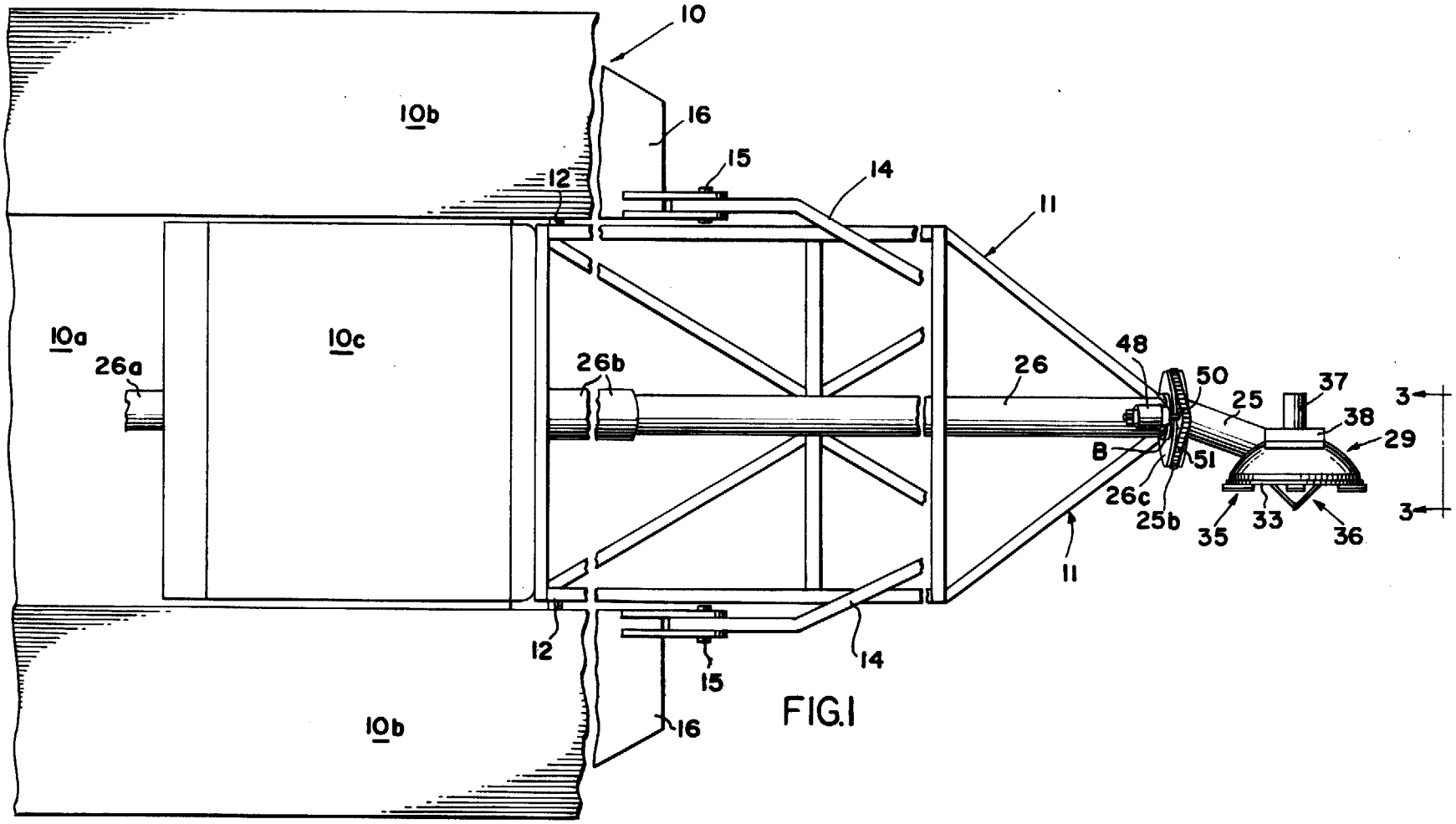
FIG. 1 is a top plan view, partly in fragmentary form, of a dredging system constructed according to the present invention.

As indicated earlier, the dredging system illustrated may be considered to include the tail section and mechanism employed in U.S. Pat. No. 3,919,791 for swinging the dredging vessel and the boom carried thereon in transverse excavating paths of travel, and for also longitudinally incrementally advancing the dredging vessel in the manner indicated in that patent. In the present case, only the boom-mounting, so-called dredge section of the complete excavating apparatus has been illustrated and generally designated 10.

The vessel 10 is floatable and includes the usual buoyancy producing construction and may, for example, be of the type described in U.S. Pat. Nos. 2,731,741 and 2,944,352 which are also incorporated herein by reference. The floatable hull 10 includes a forwardly opening well 10*a* between buoyancy producing side compartments 10*b* and mounts a vertically movable dredge ladder or boom 11 which is vertically moved in a manner described in my aforementioned U.S. Pat. No. 3,777,375. A cab 10*c* is also provided in the usual manner.

The dredge ladder 11 is pivotally mounted at 12 on the vessel 10 in the usual manner. For supporting the dredge ladder 11, an A-frame assembly generally designated 14, is swingably mounted a pivot pins 15 fixed to the front portion or prow 16 of the hull 10, and is vertically supported by a cable 17 which is fixed to the upper end thereof and is wound on a rotatable hydraulically driven hauling or winch drum 18, provided on a support platform 19 on the front of hull 10 and driven by a hydraulic motor 18*a*.

The A-frame assembly 14 mounts a pulley 20 at its upper end and supports the dredge ladder 11 by means of a cable 21 trained around the pulley 20 and another pulley 22 mounted on a pulley supporting member 23 fixed to the front end of the dredge ladder 11. As the hydraulically driven winch 18 is alternately rotated in opposite directions, the cable 21 is alternatively wound and unwound thereon to respectively raise and lower the A-frame assembly 14 and the dredge ladder 11 in the conventional manner.

The dredge ladder 11 supports a suction conduit generally designated 24, which includes a first section 25 rotatably coupled to a second section 26 in a manner which will presently be described. The section 26 includes a pump input section 26*a*, leading to the usual suction pump 27 mounted on the vessel 10, and a coupling section 26*b*. An engine E (FIG. 11) such as a suitable Diesel engine drives pump 27. Some flexibility is provided by the coupling section 26*b* to enable the pivoting movement of the suction conduit with the dredge ladder 11 about pivots 12. The slurry material, sucked via the suction conduit 24 into pump 27, is moved by the pump, via an exit conduit 28, to the desired remote location in the manner taught in the patents mentioned.

As FIGS. 1 and 3 through 6 particularly indicate, the conduit pipe section 25 supports a cutterhead assembly generally designated 29 which includes a dish-shaped material receiving housing or compartment 30. A shaft 31 is supported for rotation by the housing 30 and at its enlarged front end may be bolted to the cutterhead disc 33 by bolts 34. The disc 33, which mounts a series of radially staggered, peripherally outer knife assemblies, generally designated 35, and a central knife structure generally designated 36, is driven by a hydraulic motor 37 via a gear box 38.

The disc 33 has openings 39 extending from its outer knife-mounting face, at the knife assemblies 35, through to its inner face to communicate with the interior of housing or compartment 30 (see particularly FIGS. 7 and 8).

A seal ring 40 (FIG. 3) is secured to the housing 30 as at 41 and forwardly into a position in which there is only a running clearance provided between the rotating disc 33 and the seal ring 40 to prevent slurry material, moved through the openings 39, from leaving the compartment 30 peripherally. Each knife structure 35 (FIGS. 7 and 8) includes a holder 42 and a knife blade 43 having a cutting edge 43*a*. Provided inwardly of each knife 43, and of substantially the same length as the knife 43 and the edge 43*a* to cover the width of each opening 39, is a pump vane 44 which is fixed to the disc 33 in the position shown in FIG. 8, so that slurry material entering the compartment 30 must proceed between each knife blade 43 and a pump vane 44 through the passageway "*a*"shown in FIG. 8. In so doing, a peripheral motion will be imparted to it by blades 44 which will pump it toward the tangential opening 45 in the housing wall 30 through which material is expressed to the conduit section 25.

It should be observed that the knife assemblies 35 are provided in pairs (FIG. 7), and the letters $x$ and $y$ have been utilized to identify the radially inner and outer knife assemblies of one pair, and the letters $x'$ and $y'$ to identify the like identical outer and inner knife assemblies of the other pair. The radial positions of these knives 43 are such in each pair $x - y$ and $x' - y'$ that there is a radial lap, so that the entire disc 33 (outward of the central knife assembly 36) is diametrally accomplishing a cutting action.

As FIGS. 7, 9 and 10 particularly indicate, the central knife assembly 36 includes a pair of convergent knife holders 47 for knife blades 46, having cutting edges 46*a*. It should also be observed that the edges 46*a* radially lap the innermost knife assemblies $y$ and $y'$ so that, except for the very center of the disc, the entire front or outer surface of disc 33 is diametrally accomplishing a cutting action.

Figure 2:
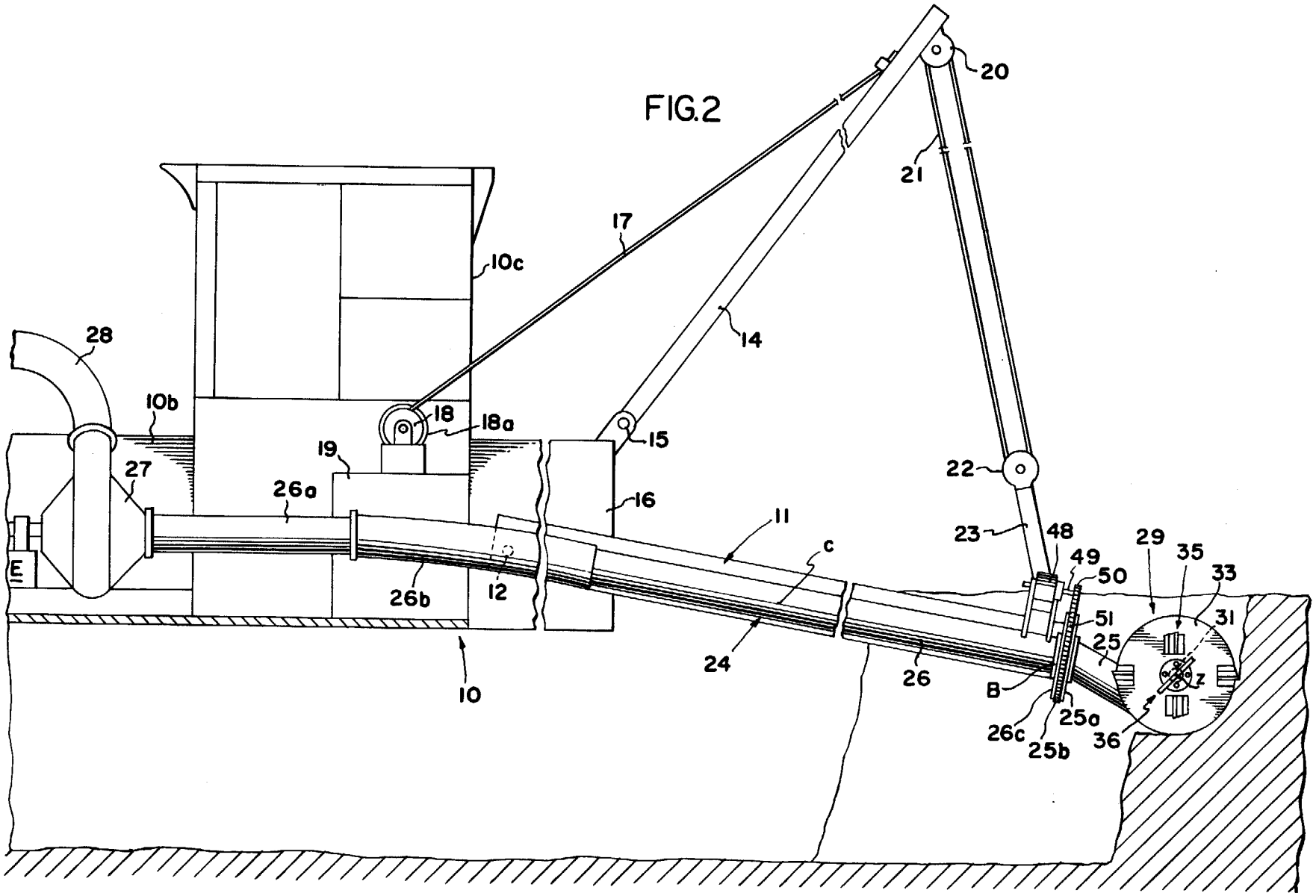
FIG. 2 is a fragmentary side elevational view thereof, illustrating the device in operation.

It is to be noted (FIG. 2) that the axis $z$ of the disc supporting shaft 32 is intersected by the centerline $c$ of the pipe section 26. Suction conduit section 26 has a flange 26*c* and suction conduit section 25 has a flange 25*a* with a sprocket part 25*b* fixed thereon. A suitable thrust bearing B is provided between the flange 26*a* and the flange 25*a*. A hydraulic motor 48, having an output shaft 49, drives a sprocket wheel 50 around which a chain 51, also trained around sprocket 25*b*, is trained.

The motor 48 is capable of revolving the flange 25*a* (and section 25) 180° in two steps. This two-step revolution occurs at the end of the horizontal swinging cutting path of travel of disc 33, during which time the disc 33 is also lowered to cut the next swath of material. With the turning of the disc 33 end-for-end, a new swath of material at the next lower level can then be cut on the return horizontal swinging travel of the dredge supporting ladder or boom 11. When the disc 33 reaches the end of its travel in the return direction, it once again is reversed by the reversible stepping hydraulic motor system 48 which revolves sprocket 25*b* then in the opposite direction 180° in two steps in a manner to be described.

THE OPERATION

Figure 3:
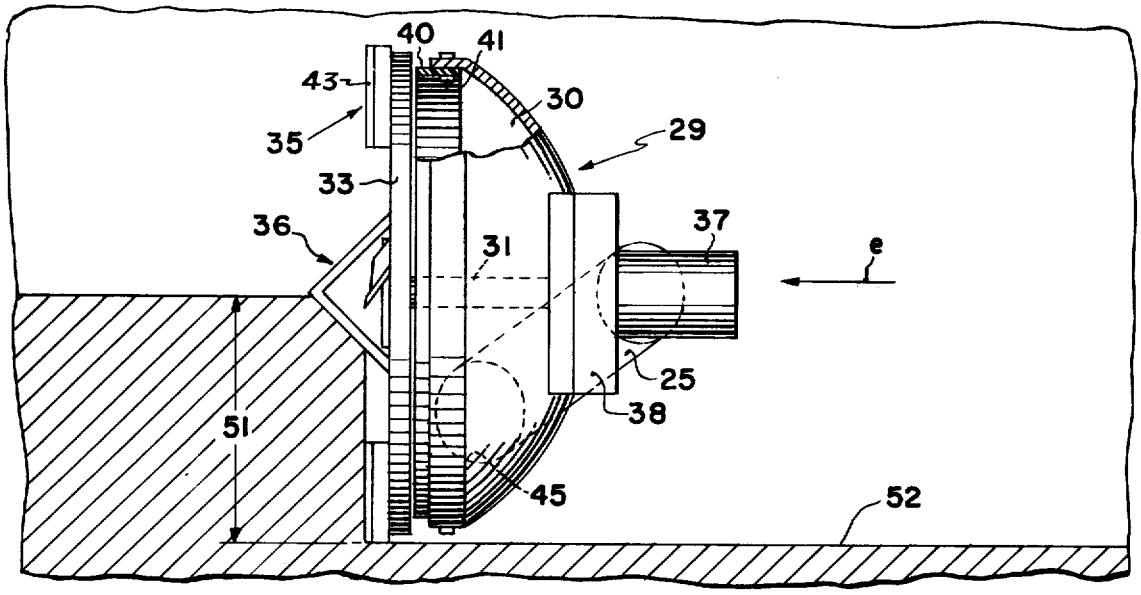
FIG. 3 is an enlarged, partly sectional side elevational view taken on the line 3—3 of FIG. 1, but with the cutterhead shown as having reached a position at one end of its transverse arc of excavating travel.
Figure 4:
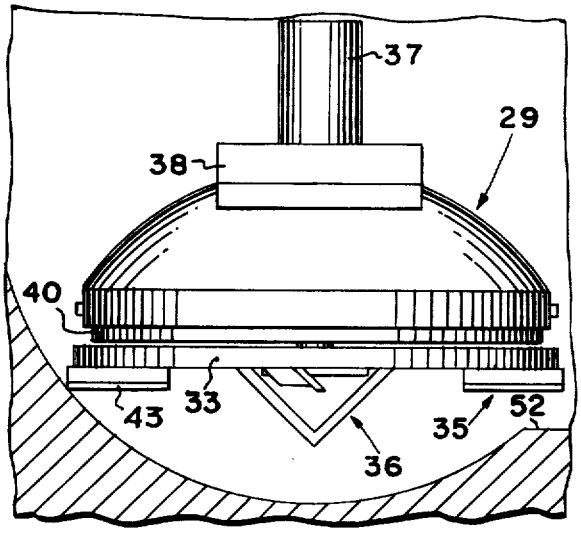
FIG. 4 is a similar view, with the cutterhead being shown as rotated through a 90° increment as it digs its way to reversed position.
Figure 5:
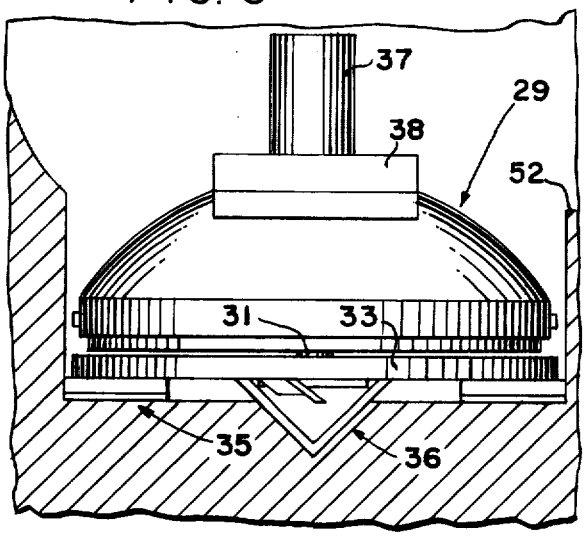
FIG. 5 shows a further view in which the partly revolved cutterhead is moved downwardly to a position in which it will cut the next layer of material.
Figure 6:
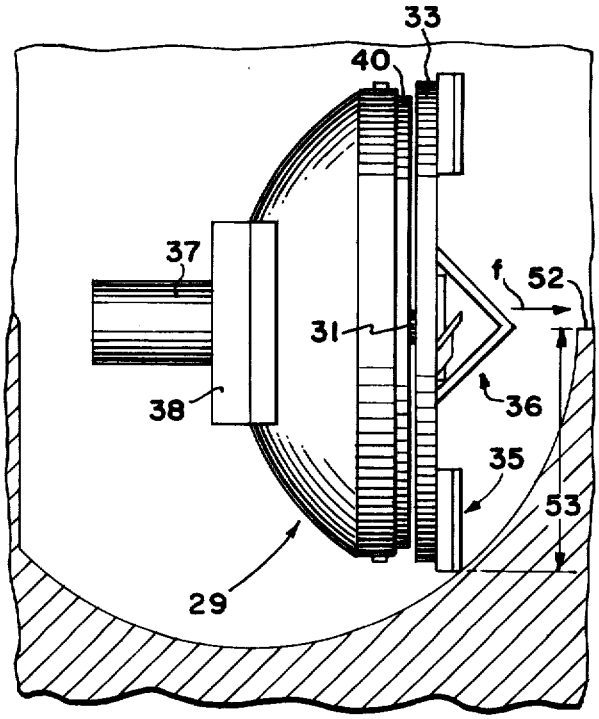
FIG. 6 is a similar view showing the cutterhead rotated the remaining 90° increment to a position reversed from the position in which it is shown in FIG. 3 ready to move in a return transverse arc cutting the next lowermost layer of material as it returns.

Directing attention now particularly to FIGS. 3 through 6, it will be assumed that the cutterhead assembly 29 has been swinging with boom or ladder 11 in a direction from right to left in FIG. 3, as indicated by the arrow *e*, and has reached the leftward limit of its horizontal path of digging travel. This might, for example, be the position indicated at 16' in FIG. 2 of U.S. Pat. No. 3,777,375. At this time, the operator will, in the manner illustrated in FIGS. 3 14 6, reverse the position of disc 33, i.e. turn it end-for-end to the FIG. 6 position while lowering it so that it can cut the next succeeding layer of material on the return left to right stroke of ladder 11 toward the position illustrated, for example, at 16" in U.S. Pat. No. 3,777,375.

Figure 11:
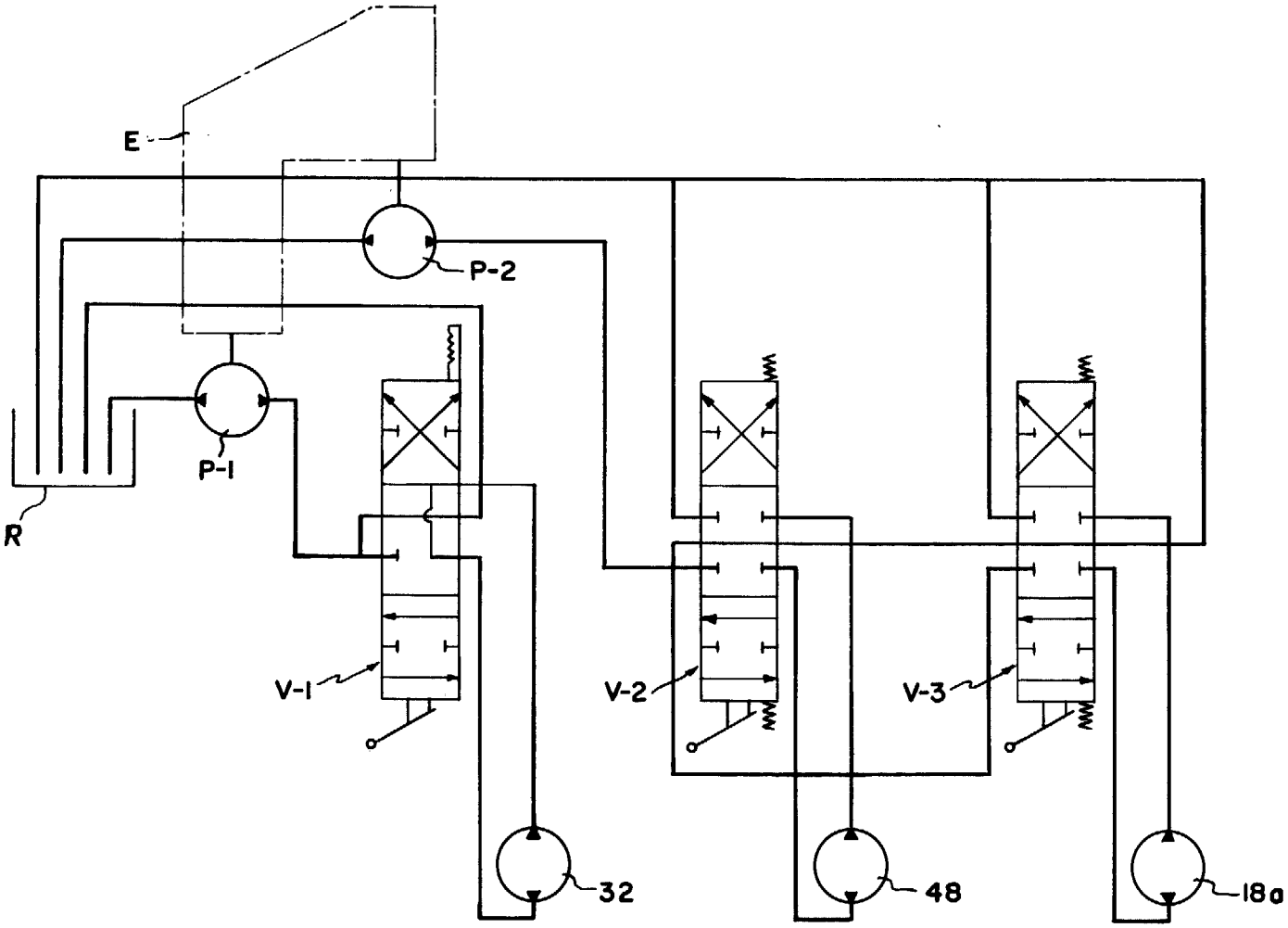
FIG. 11 is a schematic electrical control diagram.

With the construction which has been described this new method of operation is possible, and it will now be described with particular reference to FIGS. 3 through 6. In traveling from right to left in the direction *e* shown in FIG. 3, the revolving disc 33 has been removing a level of material indicated by the reference dimension 51 and has excavated to the level 52. To remove the swath of material 53 as indicated dimensionally in FIG. 6 while moving in the return direction *f*, the operator has essentially dug the clearance which permits end-to-end reversal of the position of disc 33. The hydraulic motors 37, 38, and 18*a* are schematically shown in FIG. 11 in circuit with flow control, hand operated, four-way on-off valves V-1, V-2 and V-3, which permit this operation to occur. Variable volume reversible direction pumps P-1 and P-2 driven by engine E, remove hydraulic fluid from the reservoir R and drive the motor 37 and the motors 48 and 18*a* respectively at the desired speeds.

While it has been assumed in the foregoing description that the entire vessel 10 will be swung horizontally in a to-and-fro path to accomplish the excavation of successive layers of material, it is considered that the boom or ladder 11 also could be of the type which is moved in a horizontal swinging to-and-fro path of digging travel relative to the dredge vessel 10.

When the operator has dug to the desired depth, motor 18*a* is operated to raise the boom 11 above the water or bank being dug and the vessel 10 is indexed longitudinally forwardly ahead a distance equal to about the diameter of disc 33. Then motor 48 is operated to rotate disc 33 approximately to the FIG. 4 position. The cutting head 29 is then moved downwardly to the FIG. 5 position in the manner formerly described and rotated to the FIG. 6 position so that the next swath can be cut when boom 11 is moved in the direction *f*. Of course, if boom 11 is moving in excavating arcs of more than 180°, it is not necessary to initially assume the FIG. 4 position in order to commence to excavate again.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

I claim:

1. In a dredging system for excavating material from the bed or bank of a body of water and removing it as a slurry: a floatable vessel having sides and front and rear ends; a cutterhead supporting, longitudinally forwardly extending boom mounted thereon; a suction creating means carried by said vessel; a housing mounted for pivotal movement on said boom about the generally longitudinal axis of said boom and defining a material collecting compartment; a suction conduit, connected with the suction creating means, leading from said compartment to deliver slurry therefrom to a location remote from the cutterhead housing; the housing being imperforate except for an opening leading to said suction conduit and a side opening, a sidewisely disposed rotary disc supported for rotation about an axis generally transverse to said longitudinal axis and having an inner face closing said side opening and defining one wall of said compartment, and an outer knife mounting face extending generally parallel with the boom, the disc having generally radially extending openings removed from its said axis and leading from its outer face to its inner face; and knives mounted at said openings having edges extending generally linearly generally parallel with the outer face of the disc along the openings to cut material and propel it through the openings to the inner face of the disc and the material collecting compartment of said housing; motor means for rotating the disc about its axis; means for rotating the housing, including the disc, through a downward and thence upward path of travel including partial arcs of revolution in the same direction of rotation totaling substantially 180° about said generally longitudinal axis; and means for moving said boom and cutterhead in a sidewise excavating path of travel in which the disc is disposed in a generally vertical plane.

2. The system of claim 1 wherein the openings and knives are radially staggered and slightly radially lapped.

3. The system of claim 2 wherein a central generally V-shaped knife configuration projects from the disc and is slightly in radially lapped configuration with a radially innermost knife.

4. The system of claim 1 wherein the means for rotating the disc about its axis comprises a rotary hydraulic motor connected with an input shaft extending axially rearwardly from said disc rearwardly through said compartment.

5. The system of claim 4 wherein said housing is dish-shaped and the said shaft connects with the motor via a gear reduction box generally axially disposed with respect to said housing.

6. The system of claim 1 in which said suction conduit includes a first section extending generally tangentially from said housing.

7. The system of claim 6 in which said suction conduit includes a second section communicating with said suction creating means; and means is provided for mounting said first section for rotation relative to said second section.

8. The system of claim 7 in which the means mounting said first section for rotation comprises bearing means sandwiched between a flange provided on each of said first and second conduit sections.

9. The system of claim 8 in which a drivable member is provided on the flange of said first conduit section; a rotary hydraulic motor is carried on said second conduit section; and a drive element coupled to said hydraulic motor has driving engagement with said drivable element.

10. The system of claim 1 wherein vanes provided on the rear face of said disc operate as a super-charging pump to move slurry into said conduit.

11. A dredging method for excavating material from the bed or bank of a body of water or other liquid and removing it in slurry form comprising: moving a generally vertically disposed continuously rotating disc, having cutting knives mounted thereon adjacent openings through the disc through which material cut is moved, in a horizontal path of travel against the vertical wall of a swath of material to be excavated at a level in which the swath to be cut is disposed substantially at or below the top of the disc; moving material cut through said openings while said disc is rotating and discharging it; at the end of said path of travel rotating the disc through approximately a 90° arc downwardly, while cutting and discharging material, about an axis to dispose the disc generally horizontally and the knives downward thereof; moving the disc in a straight line path downwardly while continuing to cut and discharge material a distance approximately the thickness of the next swath to be removed, and then rotating the disc upwardly through approximately an additional 90° arc in the same direction of rotation while cutting and discharging material, to again dispose the disc generally vertically, but in end-for-end reversed position.

12. The method of claim 11 in which the material discharged is collected and transported to a remote location.

13. A dredging method for excavating material from the bed or bank of a body of water or other liquid and removing it in slurry form through a conduit to a remote location comprising: moving a generally vertically disposed continuously rotating disc, connected to said conduit and having at least one cutting knife mounted on its work face adjacent an opening through the disc through which material cut is propelled from its work face through the disc, in a sidewise horizontal path of travel against the vertical wall of a swath of material to be excavated; moving material through said opening while said disc is rotating and collecting it for discharge; at the end of said path of travel rocking the disc through approximately a 90° arc downwardly, while cutting and collecting material, to dispose the disc generally horizontally and the knife downward thereof; moving the disc in a substantially linear path downwardly, while continuing to cut and collect material, and then rocking the disc upwardly through approximately an additional 90° arc in the same direction of rocking while continuing to cut and collect material, to again dispose the disc generally vertically, but in end-for-end reversed position; and applying a suction to move the collected material through said conduit.

14. In a dredging system for excavating material from the bed or bank of a body of water or other liquid and removing it as a slurry and including: a floatable vessel having sides and front and rear ends; a cutterhead supporting, longitudinally forwardly extending boom and suction conduit assembly mounted thereon; a suction creating means carried by said vessel; a housing mounted on said assembly and defining a material collecting compartment; a suction conduit, connected with the suction creating means, leading from said compartment to deliver slurry therefrom to a location remote from the housing; the improvement comprising: a sidewisely disposed rotary disc supported for rotation about an axis generally transverse to said longitudinal axis and having an inner face closing one side wall of said housing, and an outer knife mounting face extending generally parallel with the boom, the disc having at least one opening removed from its said axis and extending through the disc from its outer face to its inner face; and a knife mounted at said opening having an edge extending generally parallel with the outer face of the disc generally radially along the opening to the inner face of the disc and the material collecting compartment of said housing; motor means for rotating the disc about its axis at a cutting speed; means for moving the disc downwardly through about a 90° arc from a position in which it is disposed in a generally vertical plane, while cutting and discharging material; means for thereafter bodily moving the disc downwardly in approximately a straight line path while continuing to cut and discharge material; means for rocking the disc upwardly through about a 90° arc while continuing to cut and discharge material to return the disc to generally vertical position; and means for moving said boom and cutterhead in a sidewise excavating path of travel while the disc is disposed in generally vertical position.

* * * * *